US011992917B2

(12) United States Patent
Ha et al.

(10) Patent No.: US 11,992,917 B2
(45) Date of Patent: May 28, 2024

(54) GLASSES LENS PROCESSING APPARATUS AND METHOD WHICH USE HALL SENSOR

(71) Applicant: HUVITZ CO., LTD., Anyang-si (KR)

(72) Inventors: Seung Suk Ha, Seoul (KR); Jae Eui Gwon, Incheon (KR)

(73) Assignee: HUVITZ CO., LTD., Anyang-si (KR)

( * ) Notice: Subject to any disclaimer, the term of this patent is extended or adjusted under 35 U.S.C. 154(b) by 1098 days.

(21) Appl. No.: 16/646,208

(22) PCT Filed: Jun. 27, 2018

(86) PCT No.: PCT/KR2018/007307
§ 371 (c)(1),
(2) Date: Mar. 11, 2020

(87) PCT Pub. No.: WO2019/066208
PCT Pub. Date: Apr. 4, 2019

(65) Prior Publication Data

US 2020/0269378 A1 Aug. 27, 2020

(30) Foreign Application Priority Data

Sep. 27, 2017 (KR) ..... 10-2017-0125574

(51) Int. Cl.
*B24B 9/14* (2006.01)
*B24B 13/00* (2006.01)
(Continued)

(52) U.S. Cl.
CPC ..... *B24B 9/148* (2013.01); *B24B 9/146* (2013.01); *B24B 13/00* (2013.01); *B24B 13/06* (2013.01); *B24B 49/10* (2013.01)

(58) Field of Classification Search
CPC ..... B24B 13/00–065; B24B 13/0006; B24B 13/0012; B24B 13/0018; B24B 13/06;
(Continued)

(56) References Cited

U.S. PATENT DOCUMENTS 5,181,344 A 1/1993 Joncour et al.
2008/0192200 A1 8/2008 Iribarne

FOREIGN PATENT DOCUMENTS

JP 08-323600 12/1996
JP 11-198013 7/1999
(Continued)

OTHER PUBLICATIONS

JPO, Office Action of JP 2020-538504 dated Apr. 20, 2021.
KIPO, International Preliminary Reporton Patentability of Application No. PCT/KR2018/007307, dated Mar. 31, 2020.

*Primary Examiner* — Eric J Rosen
*Assistant Examiner* — Aaron R McConnell
(74) *Attorney, Agent, or Firm* — LEX IP MEISTER, PLLC

(57) ABSTRACT

Disclosed is an apparatus and method for processing eyeglass lens which determines the completion of the eyeglass lens processing by using a hall sensor. The eyeglass lens processing apparatus comprises: a grinding wheel mounted frame (22) mounted with a grinding wheel (20) for grinding a lens, and whose position is changed according to a predetermined grinding depth of the lens; a carriage (12) for moving the lens to contact with the grinding wheel (20), and which contacts with the grinding wheel mounted frame (22) when the lens which contacts with the grinding wheel (20) is grinded to the predetermined grinding depth; and a hall sensor detector (30) for detecting a contact of the grinding wheel mounted frame (22) and the carriage (12), wherein the hall sensor detector (30) includes a magnet (32) and a hall sensor (34) for detecting an intensity of a magnetic field generated by the magnet (32), the magnet (32) is equipped on either one of the carriage (12) and the grinding wheel mounted frame (22), and the hall sensor (34) is equipped on the other one of the carriage (12) and the grinding wheel mounted frame (22), in case an output signal of the hall
(Continued)

sensor (34) is "A" when the grinding wheel mounted frame (22) and the carriage (12) are in contacts with each other, if the output signal of the hall sensor (34) is smaller or larger than "A" by a tolerance, it is determined that the grinding wheel mounted frame (22) and the carriage (12) are in a separated state.

2 Claims, 3 Drawing Sheets

(51) Int. Cl.
*B24B 13/06* (2006.01)
*B24B 49/10* (2006.01)

(58) Field of Classification Search
CPC ..... B24B 41/06; B24B 41/061; B24B 41/005; B24B 49/10; B24B 49/105; B24B 49/00–186
See application file for complete search history.

(56) References Cited

FOREIGN PATENT DOCUMENTS

| | | |
|---|---|---|
| JP | 2005-254353 | 9/2005 |
| JP | 2008-521635 | 6/2008 |
| KR | 10-0645779 | 11/2006 |
| KR | 10-2006-0124156 | 12/2006 |
| KR | 10-1897911 | 9/2018 |

GLASSES LENS PROCESSING APPARATUS AND METHOD WHICH USE HALL SENSOR

FIELD OF THE INVENTION

This invention relates to an apparatus and method for processing eyeglass lens using a hall sensor, and more particularly, to an apparatus and method for processing eyeglass lens which determines the completion of the eyeglass lens processing by using a hall sensor.

BACKGROUND OF THE INVENTION

In order to produce eyeglass lens, a commercially available circular lens (commonly, "blank lens") are processed into a desired eyeglass lens shape, for example, a shape of a glass frame. FIG. 1 is a perspective view showing an internal structure of a conventional eyeglass lens processing apparatus. As shown in FIG. 1, the eyeglass lens processing apparatus includes a pair of lens fixing shafts (10) for clamping a lens (not shown) to be processed; a carriage (12) for supporting the lens fixing shafts (10) and changing the position of the lens fixing shafts (10); a lens rotation motor (13) for rotating the lens fixing shafts (10); a transverse driving means (16) for moving the carriage (12) in left and right directions; a longitudinal driving means (18) for moving the carriage (12) in the up and down directions; and a grinding wheel (20) for grinding the lens fixed with the lens fixing shafts (10) (see Korean Patent No. 10-0645779).

In order to process the eyeglass lens, firstly the lens is fixed between the lens fixing shafts (10) and the lens rotation motor (13) is driven so that a circumferential position of the lens to be grinded faces toward the grinding wheel (20). Next, the transverse driving means (16) and the longitudinal driving means (18) are operated to move the carriage (12) up and down directions and left and right directions so that the lens contacts with the grinding wheel (20). Then, the grinding wheel (20) rotates with a high speed to grind the contacted part of the lens. As the lens is gradually grinded by the grinding wheel (20), the carriage (12) moves downwardly by gravity according to the grinding depth of the lens. When the lens is grinded to a desired depth, the carriage (12) abuts and supported by a grinding wheel mounted frame (22, see FIG. 2) and stops.

FIG. 2 shows the positional relationship between the carriage (12) mounted with the lens and the grinding wheel mounted frame (22) mounted with the grinding wheel (20) in a conventional eyeglass lens processing apparatus. At a predetermined circumferential position of the lens, the grinding depth of the lens (lens size) is determined according to the shape of the glass frame. According to the grinding depth, the position (height) of the grinding wheel mounted frame (22) is determined. As shown in FIG. 2, when the lens is grinded to the predetermined grinding depth, the carriage (12) on which the lens is fixed, moves downwardly, finally abuts with the grinding wheel mounted frame (22) positioned at the predetermined height, and thereby stops. The eyeglass lens processing apparatus detects the contact between the carriage (12) and the grinding wheel mounted frame (22) to determine whether the lens is completely grinded to the grinding depth. In the conventional eyeglass lens processing apparatus, electrical contacts (12*a*, 22*a*) are provided on the contact positions of the carriage (12) and the grinding wheel mounted frame (22), respectively. From the on/off signal of the electrical contacts (12*a*, 22*a*), namely, from the current flow between the electrical contacts (12*a*, 22*a*), the completion of lens processing can be detected.

Such a contact detection using the electrical contacts (12*a*, 22*a*) has been used for a long time not only in the automatic lens processing apparatus but also in the semi-automatic lens processing apparatus because its cost is inexpensive and the wear resistance thereof is excellent. However, in this method, a current is applied to the mechanical electrical contacts (12*a* and 22*a*) to determine its on or off states. Thus, as time passes, the electrical contacts (12*a*, 22*a*) corrode and a carbonized film can be formed thereon, and the reliability of the electrical contacts (12*a*, 22*a*) decreases. In particular, in seaside area or when processing water contains impurities such as a chlorine component, the reliability of the electrical contacts (12*a*, 22*a*) rapidly decreases. Therefore, recently, instead of the electrical contacts (12*a*, 22*a*) method, an expensive contact detection method which uses an encoder or a strain gauge and measures a size in a direction (hereinafter, Y direction) is introduced.

Technical Problem

An object of the present invention is to provide an apparatus and method for processing eyeglass lens which detects the completion of lens processing in a non-contact manner without using a conventional electrical contact method (a contact manner).

Other object of the present invention is to provide an apparatus and method for processing eyeglass lens which detects the completion of lens processing by using a hall sensor which detects a change of magnetic field strength in a voltage value.

Another object of the present invention is to provide an apparatus and method for processing eyeglass lens which detects the completion of lens processing in an inexpensive, durable and reliable manner.

Technical Solution

In order to achieve the above objects, the present invention provides an eyeglass lens processing apparatus, comprising:

- a grinding wheel mounted frame (22) mounted with a grinding wheel (20) for grinding a lens, and whose position is changed according to a predetermined grinding depth of the lens;
- a carriage (12) for moving the lens to contact with the grinding wheel (20), and which contacts with the grinding wheel mounted frame (22) when the lens which contacts with the grinding wheel (20) is grinded to the predetermined grinding depth; and
- a hall sensor detector (30) for detecting a contact of the grinding wheel mounted frame (22) and the carriage (12),
- wherein the hall sensor detector (30) includes a magnet (32) and a hall sensor (34) for detecting an intensity of a magnetic field generated by the magnet (32), the magnet (32) is equipped on either one of the carriage (12) and the grinding wheel mounted frame (22), and the hall sensor (34) is equipped on the other one of the carriage (12) and the grinding wheel mounted frame (22),
- in case an output signal of the hall sensor (34) is "A" when the grinding wheel mounted frame (22) and the carriage (12) are in contacts with each other, if the output signal of the hall sensor (34) is smaller or larger than "A" by a tolerance, it is determined that the grinding wheel mounted frame (22) and the carriage (12) are in a separated state.

Also, the present invention provides an eyeglass lens processing method, comprising the steps of:

determining a reference output signal "A0" when a carriage (12) mounted with a lens contacts with a grinding wheel mounted frame (22) mounted with a grinding wheel (20) for grinding the lens, wherein the reference output signal "A0" is determined with a hall sensor detector (30) including a magnet (32) which is equipped on either one of the carriage (12) and the grinding wheel mounted frame (22) and a hall sensor (34) which is equipped on the other one of the carriage (12) and the grinding wheel mounted frame (22) and detects an intensity of a magnetic field generated by the magnet (32);

performing a lens processing to a target depth at a first grinding direction, detecting an output signal of the hall sensor (34), and determining whether the output signal of the hall sensor (34) is within "A0±a" (a: tolerance);

determining that the grinding wheel mounted frame (22) and the carriage (12) are in contact and finishing the lens processing at the first grinding direction when the output signal of the hall sensor (34) is within "A0±a" (a: tolerance), and updating the reference output signal to "A1" which is an output signal of the hall sensor (34) at that time; and rotating the lens to a second grinding direction which is a next grinding direction, and repeating the determining step and the updating step of the reference output signal for processing the entire lens edge.

Technical Solution

According to the apparatus and method for processing eyeglass lens of the present invention, the completion of lens processing can be detected in a non-contact manner without using a conventional electrical contact method (a contact manner), but with using a hall sensor which detects a change of magnetic field strength in a voltage value. According to the present invention, the completion of lens processing can be detected in an inexpensive, durable and reliable manner.

DETAILED DESCRIPTION OF THE INVENTION

Figure 1:
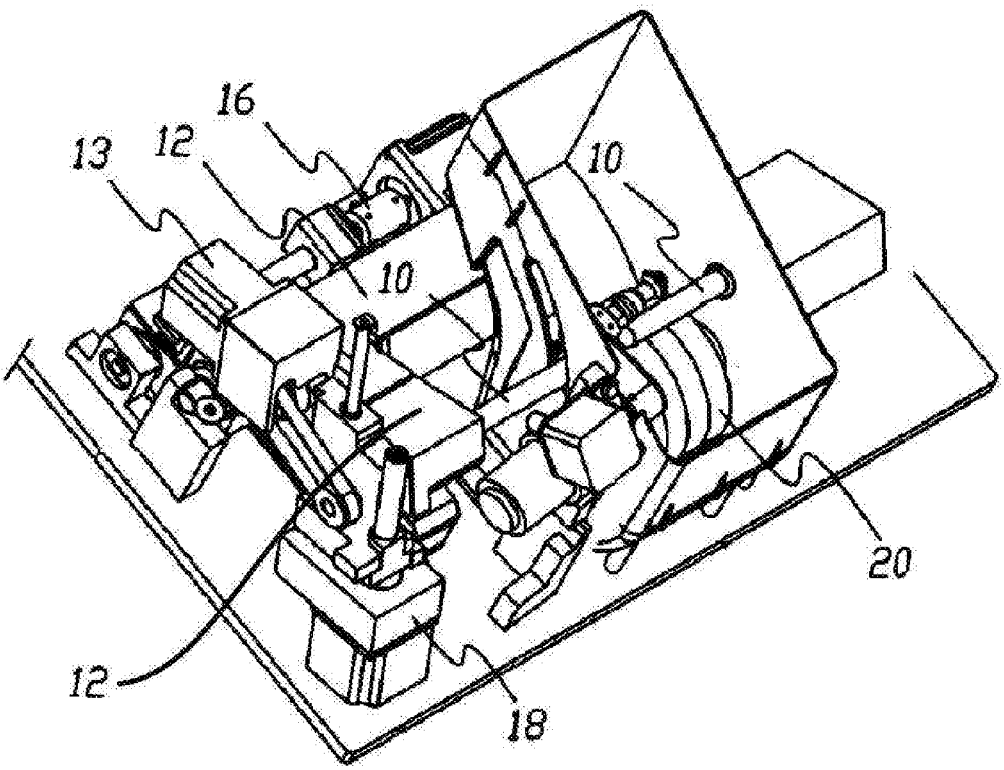
FIG. 1 is a perspective view showing an internal structure of a conventional eyeglass lens processing apparatus.
Figure 2:
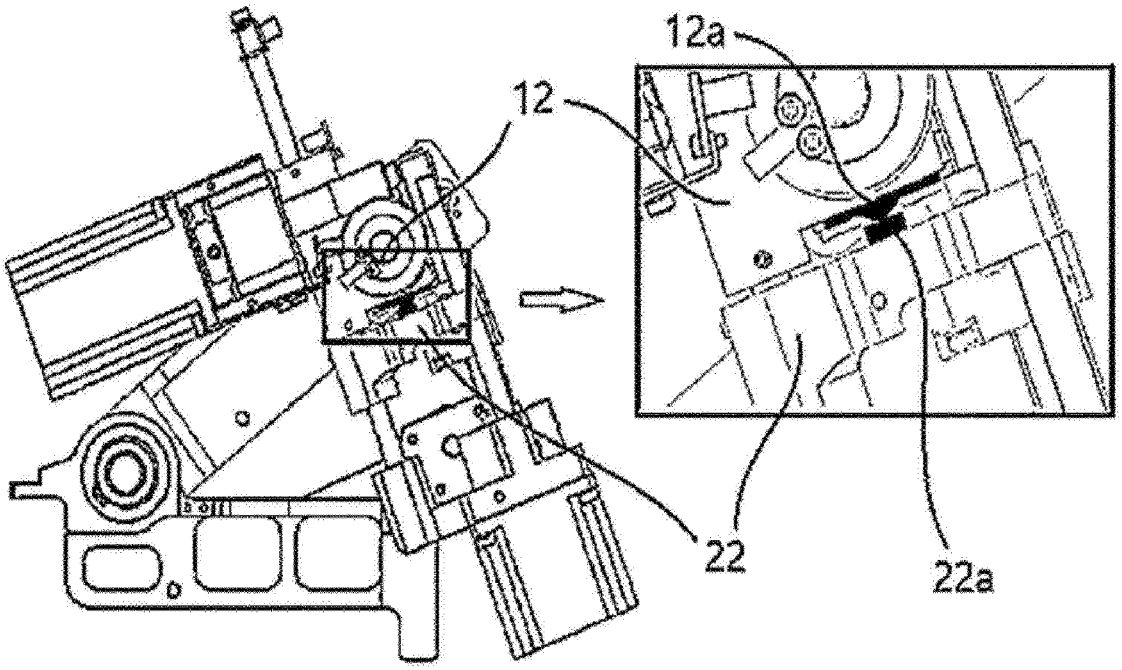
FIG. 2 is a drawing which shows the positional relationship between the carriage mounted with the lens and the grinding wheel mounted frame mounted with the grinding wheel in a conventional eyeglass lens processing apparatus.

Hereinafter, the present invention will be described in detail with reference to the accompanying drawings. In the accompanying drawings, the same reference numerals are assigned to elements that perform the same or similar functions with the conventional elements.

Figure 3:
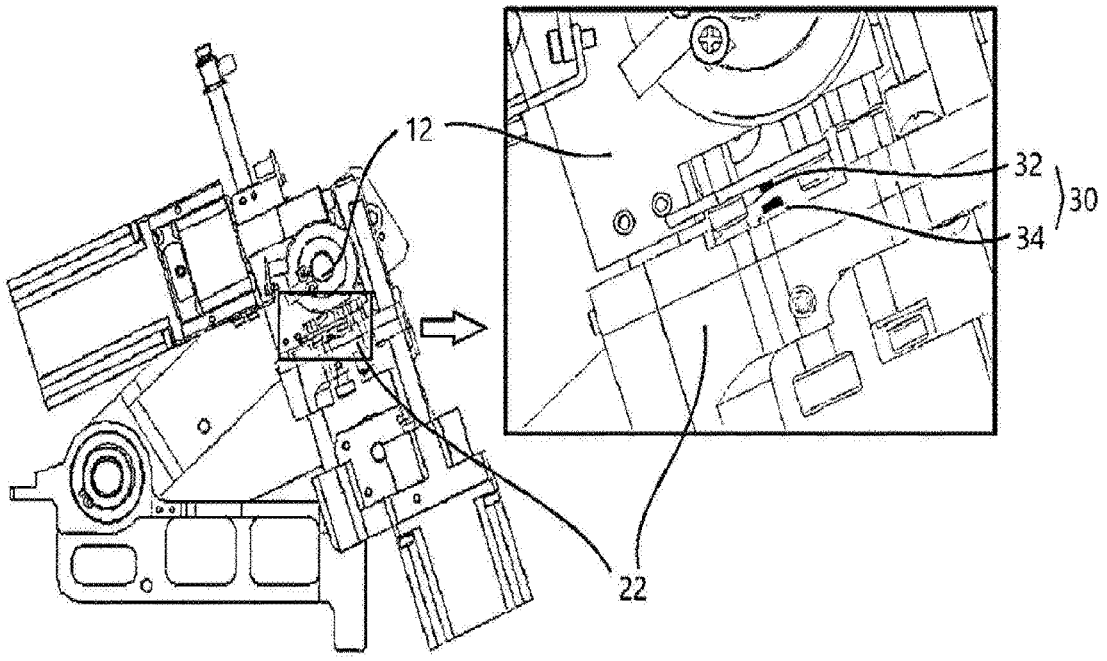
FIG. 3 is a drawing which shows the structure of the eyeglass lens processing apparatus having a hall sensor according to an embodiment of the present invention.

FIG. 3 is a drawing which shows the structure of the eyeglass lens processing apparatus having a hall sensor according to an embodiment of the present invention. As shown in FIG. 3, the eyeglass lens processing apparatus according to the present invention comprises a grinding wheel mounted frame (22); a carriage (12); and a hall sensor detector (30).

The grinding wheel mounted frame (22) is mounted with a grinding wheel (20, see FIG. 1) for grinding a lens, and has a conventional traveling block whose position (height) is changed according to the predetermined grinding depth of the lens (hereinafter, "target depth") (See Korean Patent No. 10-0645779). For example, if the desired grinding depth of the lens is large, i.e., the desired (target) size of the processed eyeglass lens is small, the grinding wheel mounted frame (22) is located relatively lower position so that the blank lens is grinded by the large grinding depth from the outer edge of the blank lens to the desired size of the eyeglass lens. On the contrary, if the desired grinding depth of the lens is small, i.e., the desired (target) size of the processed eyeglass lens is large, the grinding wheel mounted frame (22) is located relatively higher position so that the blank lens is grinded by the small grinding depth from the outer edge of the blank lens to the desired size of the eyeglass lens. The grinding wheel mounted frame (22) travels upwardly and downwardly along the Y direction by using a motor. The size of the processed lens is determined by the position (height) of the grinding wheel mounted frame (22) which is driven by the motor.

The carriage (12) on which the lens is mounted is a conventional device for moving the mounted lens to contact with the grinding wheel (20). The carriage (12) moves and rotates the lens upwardly, downwardly, and in left and right directions so that the lens contacts with the grinding wheel (20). When the lens in contact with the grinding wheel (20) is grinded, the carriage (12) moves downwardly, for example, by gravity, and the distance between the carriage (12) and the grinding wheel mounted frame (22) is decreased. When the lens is gradually grinded so that the grinding depth of the lens reaches the predetermined grinding depth, the "target depth" (that is, when the grinding is completed), the carriage (12) and the grinding wheel mounted frame (22) come into contacts with each other. When the carriage (12) and the grinding wheel mounted frame (22) contact with each other, the lens processing is completed at the grinding direction. Thereafter, the lens is separated from the grinding wheel (20), and is rotated to the next grinding direction. Then, the position of the grinding wheel mounted frame (22) is adjusted according a new target depth at the next grinding direction. Then the lens is again moved to contact with the grinding wheel (20) to process the lens at the next grinding direction.

The eyeglass lens processing apparatus according to the present invention uses the hall sensor detector (30) to detect the contact of the grinding wheel mounted frame (22) and the carriage (12). As shown in FIG. 3, the hall sensor detector (30) includes a magnet (32) and a hall sensor (34). The magnet (32) is equipped on either one of the carriage (12) and the grinding wheel mounted frame (22), and the hall sensor (34) is equipped on the other one of the carriage (12) and the grinding wheel mounted frame (22). In the eyeglass lens processing apparatus according to the present invention, the grinding wheel mounted frame (22) physically contacts with the carriage (12) to stop the downward movement of the carriage (12), namely, works as a mechanical stopper. The contact of the grinding wheel mounted frame (22) and the carriage (12) is determined by the detection signal of the hall sensor detector (30).

The hall sensor (34) is a sensor that detects the direction and magnitude of a magnetic field by using a hall effect. The hall effect means a phenomenon in which, when a magnetic field is applied to a conductor through which current flows, a voltage is produced in a direction perpendicular to the current and the magnetic field. The hall sensor (34) detects the intensity of the magnetic field generated by the magnet (32) to determine the position of the magnet (32). Therefore, it can be determined whether the grinding wheel mounted frame (22) and the carriage (12) are in contact with each other by using the output signal of the hall sensor (34). For example, in case the output signal of the hall sensor (34) is "A" when the grinding wheel mounted frame (22) and the carriage (12) are in contacts with each other, if the output signal of the hall sensor (34) is smaller or larger than "A" (which depends on the polarity direction of the magnet), it may be determined that the grinding wheel mounted frame (22) and the carriage (12) are in a separated state.

Figure 4:
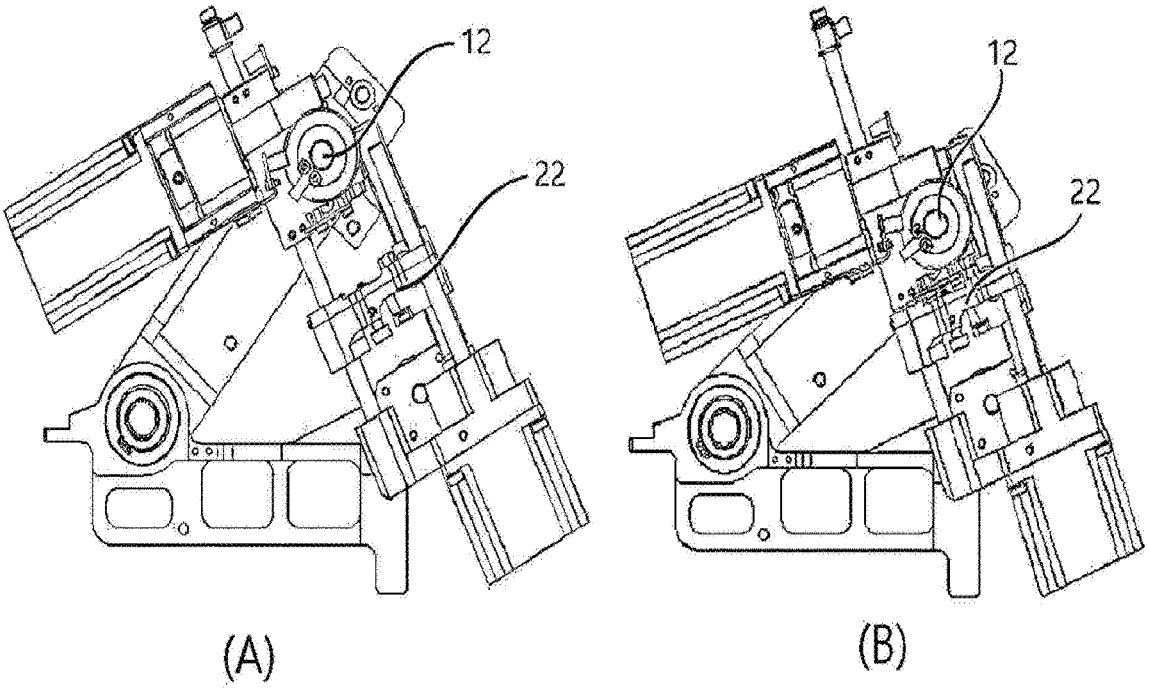
FIG. 4 is a drawing which shows the states where the center of mass of the grinding wheel mounting portion and the carriage is high (A) and where the center of mass is low (B).

In the eyeglass lens processing apparatus according to the present invention, the contact of the grinding wheel mounted frame (22) and the carriage (12) is detected by using the output signal of the hall sensor (34). In this case, measurement errors might be generated due to the following reasons: (i) as shown in FIG. 4, the centers of mass of the grinding wheel mounted frame (22) and the carriage (12) are changed according to the Y-direction positions of the grinding wheel mounted frame (22) and the carriage (12), and the sensitivity of the hall sensor (34) can be changed according to the positions; (ii) the position of the grinding wheel mounted frame (22) can be changed in the Y-direction due to the vibration of the grinding wheel mounted frame (22) during a lens grinding process; and (iii) the output signals of the magnet (32) and the hall sensor (34) can be changed in accordance with the ambient temperature.

Figure 5:
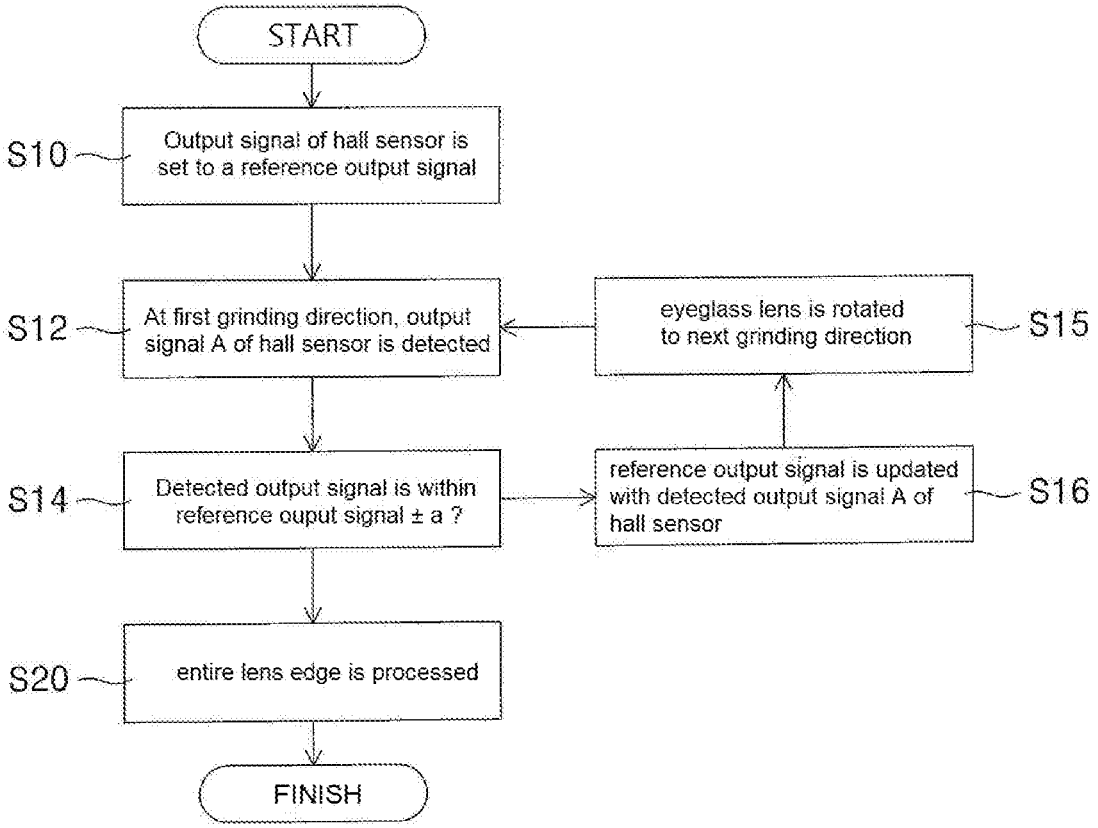
FIG. 5 is a flow chart which shows an eyeglass lens processing method according to the present invention.

Therefore, in the eyeglass lens processing apparatus and method according to the present invention, the output signal of the hall sensor (34) is corrected as follows. FIG. 5 is a flowchart which shows an eyeglass lens processing method according to the present invention. As shown in FIG. 5, when the eyeglass lens processing starts, the carriage (12) mounted with a lens is moved to contact with the grinding wheel mounted frame (22), and the output signal "A0" of the hall sensor (34) at that time is set to a reference output signal (S 10). Next, the lens processing is performed to a target depth at the first grinding direction (for example, 0 degree direction among the 0 to 360 degree directions), and the output signal of the hall sensor (34) is detected (S 12). Then it is determined whether the output signal of the hall sensor (34) is within "A0±a" (a: tolerance or permissible error) (S14). When the output signal of the hall sensor (34) is within "A0±a" (a: tolerance or permissible error), it is determined that the grinding wheel mounted frame (22) and the carriage (12) are in contact, and the processing at the first grinding direction is finished. The output signal of the hall sensor (34) at that time "A1" is updated to the reference output signal (S16). Namely, the reference output signal is renewed to "A1" from "A0". Next, the eyeglass lens is rotated to the next grinding direction (second grinding direction) (S 18), and the lens processing is performed to a target depth at the second grinding direction, and the output signal A2 of the hall sensor (34) is detected, and then it is determined whether the output signal of the hall sensor (34) is within "A1±a" (a: tolerance or permissible error) (S12). When the lens edge is processed circumferentially by n steps, the angle between the first grinding direction and the second grinding direction is 1 revolution/n. For example, when the entire lens edge is processed by 72 processing steps, the lens angle of 1 revolution/n (n=72) is 360/72, i.e., 5 degrees. At this time, when the output signal "A2" of the hall sensor (34) is within "A1±a", it is determined that the grinding wheel mounted frame (22) and the carriage (12) are in contact with each other. The output signal "A2" is updated to the reference output signal (S16). By repeating the above-described steps, the entire lens edge is processed (S 20), and the lens processing is finished. Here, the tolerance "a" is a range for determining whether the output signal of the hall sensor (34) is equal to the reference output signal. For example, the tolerance "a" can be 2% of the reference output signal, preferably 1%, more preferably 0.5% of the reference output signal.

In this way, the output signal "A" of the hall sensor (34) is updated at every grinding direction "n". The updated output signal at a grinding direction "n" is used as the new reference output signal to determine whether the grinding wheel mounted frame (22) is in contacts with the carriage (12) at the next grinding direction "n+1". As such, when the reference output signal of the hall sensor (34) is updated at every grinding direction, the following advantages can be obtained. (i) The change of the output signal of the hall sensor (34) according to the Y direction position changes of the grinding wheel mounting part (22) and the carriage (12) can be minimized. As a result, the errors due to the Y-direction position changes of the grinding wheel mounted frame (22) and the carriage (12) can be minimized. (ii) In addition, when a low pass filter (LPF) for filtering out the vibration frequency of the grinding wheel (20) is attached to the hall sensor (34), the output signal variation due to the vibration of the grinding wheel mounted frame (22) is further prevented. (iii) In addition, the output signal of the hall sensor (34) can be determined and corrected at every time when using the eyeglass lens processing apparatus. Thus, the output signal error of the hall sensor 34 according to the ambient temperature change can be prevented.

The invention claimed is:

1. An eyeglass lens processing method, comprising the steps of:

determining a reference output signal "A0" when a carriage (12) mounted with a lens contacts with a grinding wheel mounted frame (22) mounted with a grinding wheel (20) for grinding the lens, wherein the reference output signal "A0" is determined with a hall sensor detector (30) including a magnet (32) which is equipped on either one of the carriage (12) and the grinding wheel mounted frame (22) and a hall sensor (34) which is equipped on the other one of the carriage (12) and the grinding wheel mounted frame (22) and detects an intensity of a magnetic field generated by the magnet (32);

performing a lens processing to a target depth at a first grinding direction, detecting an output signal of the hall sensor (34), and determining whether the output signal of the hall sensor (34) is within "A0±a" (a: tolerance), wherein the tolerance "a" is a range for determining whether the output signal of the hall sensor (34) is equal to the reference output signal, and the tolerance "a" is 2% of the reference output signal;

determining that the grinding wheel mounted frame (22) and the carriage (12) are in contact and finishing the lens processing at the first grinding direction when the output signal of the hall sensor (34) is within "A0±a"

(a: tolerance), and updating the reference output signal to "A1" which is an output signal of the hall sensor (34) at that time; and rotating the lens to a second grinding direction which is a next grinding direction, and repeating the determining step and the updating step of the reference output signal for processing the entire lens edge.

2. The eyeglass lens processing method of claim 1, wherein the output signal of the hall sensor (34) is updated at every grinding direction, and the reference output signal at every grinding direction is updated to the updated output signal of the hall sensor (34) to determine whether the grinding wheel mounted frame (22) is in contact with the carriage (12) at a next grinding direction.

* * * * *